US005152324A

United States Patent [19]

Froment

[11] Patent Number: 5,152,324

[45] Date of Patent: Oct. 6, 1992

[54] DEVICE FOR COUPLING THE HEDDLE FRAMES AND TRANSMISSION ELEMENTS IN A SHED-FORMING MECHANISM

[76] Inventor: Jean-Paul Froment, La Creuse Sud, Doussard, France, 74210

[21] Appl. No.: 728,720

[22] Filed: Jul. 9, 1991

[30] Foreign Application Priority Data

Jul. 17, 1990 [FR] France ..... 90 09351

[51] Int. Cl.[5] ..... D03C 9/06

[52] U.S. Cl. ..... 139/82; 139/88; 139/91; 403/21; 403/118

[58] Field of Search ..... 403/21, 118, 43-48; 139/91, 87, 88, 82

[56] References Cited

U.S. PATENT DOCUMENTS 4,771,812 9/1988 Yokoi ..... 139/82

4,877,060 10/1989 Froment et al. ..... 139/82

5,002,097 3/1991 Yokoi ..... 139/82

FOREIGN PATENT DOCUMENTS 521289 7/1963 Belgium .

970624 1/1951 France .

2617204 12/1988 France .

*Primary Examiner*—Andrew M. Falik

[57] ABSTRACT

In a mechanism for forming the shed in a weaving loom a combination including a heddle frame, a transmission element, and a coupling device, wherein the transmission element includes a threaded portion which is threadingly receiving in a bush provided with tenon-like shoulders which are engageable within mortise-like notches formed in a pair of spaced plates fixed to the heddle frame.

7 Claims, 2 Drawing Sheets

DEVICE FOR COUPLING THE HEDDLE FRAMES AND TRANSMISSION ELEMENTS IN A SHED-FORMING MECHANISM

BACKGROUND OF THE INVENTION

1. Field of the Invention

The present invention relates to dobbies and other mechanisms for forming the shed in weaving machines, and more particularly to the coupling of the heddle frames to the cables or other transmission elements intended for moving them.

2. History of the Related Art

A large number of different systems have been proposed in practice, of which certain are arranged to allow the adjustment of the heddle frames in height, and reference may be made in particular to documents FR-A-970 624 (TESSRAION), BE-A-521 289 (LINDAVER DORNIER), EP-A-325 547 (STAUBLI) and EP-A-161 375 (SULZER).

Patent FR-A-2 617 204 to STAUBLI discloses a coupling device comprising conjugate male and female members in the form of tenons and mortises, some of which are fixed to the uprights of the frame, the others to the transmission elements. The members fixed to the uprights are split parallel to the plane of the frame so as to be traversed by the transmission elements and to form, on either side of the transmission elements, contact surfaces between the tenions and mortises for the transmission of forces.

Such an arrangement is most advantageous as it makes it possible to reduce to a considerable extent, or even virtually eliminate, the overhang existing between each of the uprights of the heddle frame and the axis of the cable which ensures displacement thereof. Consequently, the two conjugate members of each device require no reciprocal fixation, their fit with reduced clearance in the manner of a tenon and mortise being sufficient to ensure, alone, the transmission of the drawing efforts.

In the embodiment shown and described in the Patent mentioned above, the member which is intended to be secured to the transmission element was provided with a mechanism including a jaw provided with two opposite oblique faces adapted to cooperate with an oblique ramp formed on one and the other of two pushers assembled to each other by a locking screw. Although such a structure allows precise adjustment of the heddle frame with respect to the transmission element, the construction is nonetheless relatively complex and expensive.

Furthermore, with a view to avoiding any parasitic lateral displacement of the member fixed on the transmission element or cables during operation of the weaving loom, particularly under the effect of torsional forces exerted on the cables, it was necessary to provide the member in question with a heel element whose free end is engaged with clearance in the opening of a fixed vertical slide. It is clear that this arrangement nonetheless complicates the whole assembly of the heddle frames.

It is a principal object of the present invention to overcome the drawbacks set forth hereinabove, while conserving the advantages of the devices according to Patent FR-A-2 617 204 (STAUBLI).

SUMMARY OF THE INVENTION

The invention therefore provides a device for coupling the heddle frames and the transmission elements of a mechanism for forming the shed. of the type including conjugate male and female members in the form of tenons and mortises, some of which are fixed to the uprights of the frame, the others to the transmission elements, the members fixed to the uprights being split parallel to the plane of the frame so as to be traversed by the transmission elements and to form, on either side of these elements, contact surfaces between the tenons and mortises for the transmission of the forces, characterized in that the member adapted to be fixed on the transmission element is constituted by a cylindrical bush whose axial opening is threaded in order to be mounted by screwing on a threaded part formed on the transmission element so as to be disposed in the vicinity of the top of the frame. The bush has at least two annular shoulders offset axially one above the other in order to cooperate with the conjugate contact surfaces of the member secured to the upright of the heddle frame.

In fact, the invention consists in making the member which is to be fixed on the cable or other transmission element in the form of a cylindrical bush whose axial opening is tapped in order to be screwed on a threaded part provided on the element so as to be disposed in the vicinity of the top of the heddle frame. The bush has at least two annular shoulders offset axially one above the other which cooperates with the conjugate contact surfaces of the member rendered fast with the upright of the heddle frame.

It will be readily appreciated that the fixing of the cylindrical bush by screwing allows an adjustment which is at least as precise and easy as that obtained by the mechanism with oblique pushers and jaws of the prior art Patent, while being of a much simplified structure. It should be noted that this adjustment may very easily be effected further to the positioning of the bush in the upper part of the heddle frame. Furthermore, the cylindrical profile of the bush allows free angular displacement of the transmission element with respect to the environment (adjacent heddle frames and/or fixed structure) and to the conjugate member fixed to the frame, consequently avoiding having to ensure rotational immobilization of the bush.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
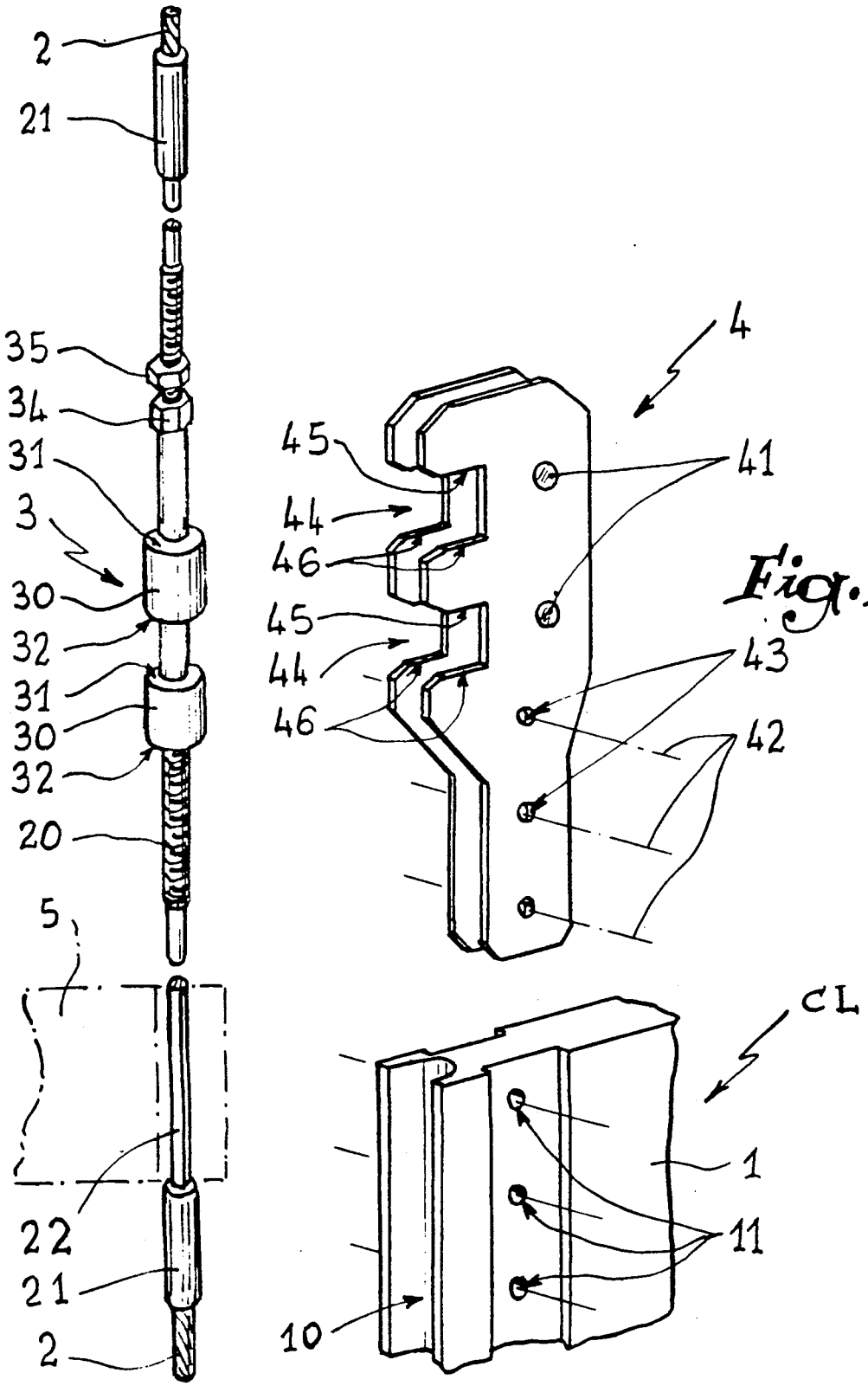
FIG. 1 is a view in perspective showing the pieces which constitute the coupling device according to the invention, prior to assembly thereof.

Referring now to the drawings, reference 1 designates the upper upright of a heddle frame CL. The vertical edge of the upright which faces outwardly has a groove 10 with rounded bottom cut out therein, to the rear of which are provided three through holes 11. Reference 2 designates one of the two traction elements intended for the vertical movement of the heddle frame CL. The 2 is a cable which is interrupted by a threaded rod 20 whose ends are provided with endpieces 21 adapted to be crimped or otherwise fixed on the ends of the cable.

Figure 2:
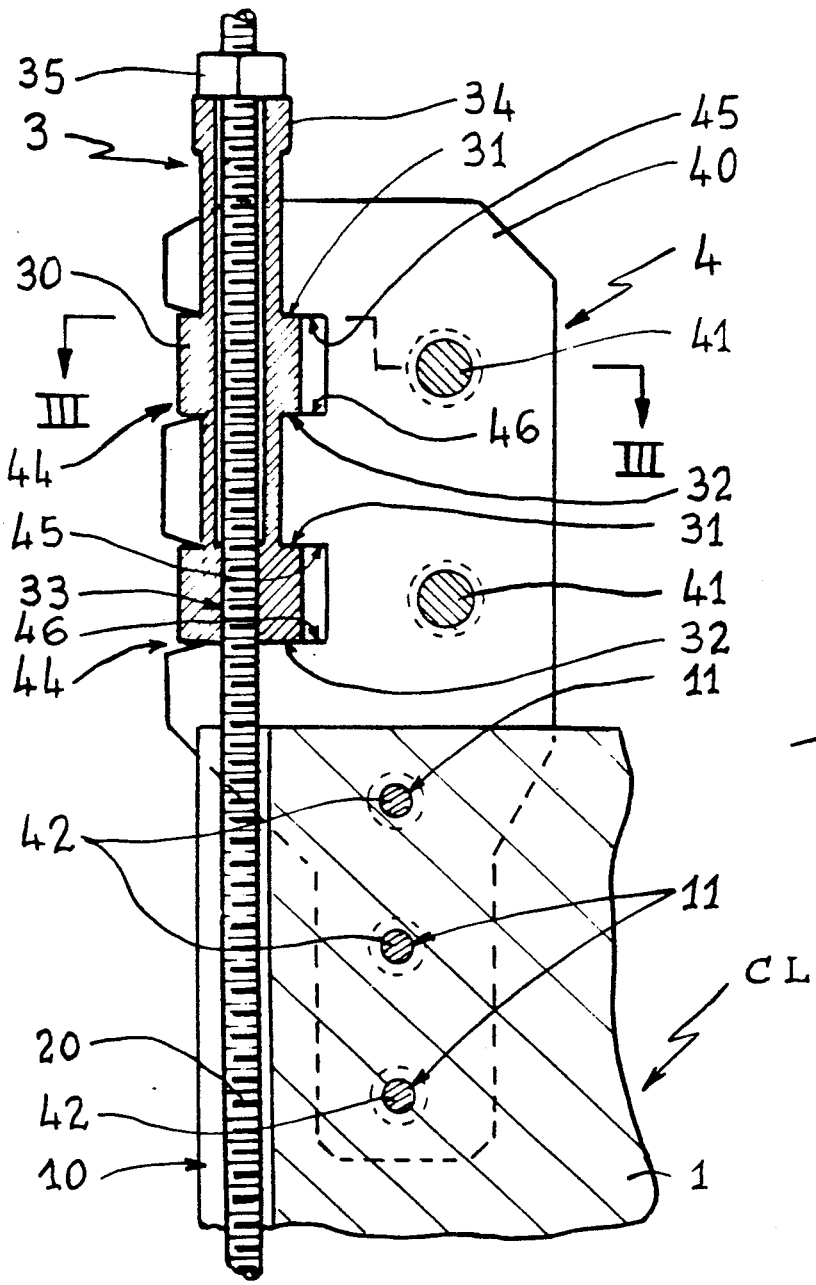
FIG. 2 is a vertical section of this same device, once the pieces are assembled.
Figure 3:
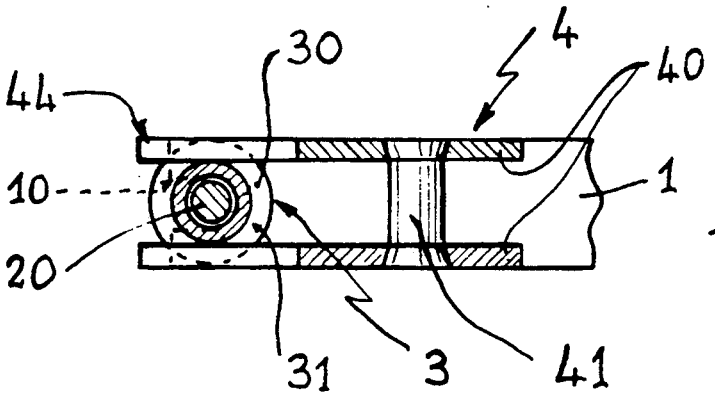
FIG. 3 is a horizontal section along plane III—III of FIG. 2.

As illustrated in FIGS. 1 to 3, on rod 20 is engaged a bush 3 which presents two superposed cylindrical stops 30 of larger diameter, each of which thus defines two opposite annular shoulders 31 and 32. It should be observed that, at the lower stop 30, the axial opening of the bush 3 is provided to be threaded at 33 in order to cooperate with the threading of the rod 20. It should further be noted that the upper stop 30 is surmounted by a part 34 of hexagonal profile, with which is associated a counter-nut 35 screwed on rod 20.

With this bush 3, assimilable to a tenon-shaped member as will be more readily understood hereinafter, there is connected a member 4 forming mortise, which member is carried by the upper upright 1. As shown, member 4 includes two vertical plates 40 assembled on each other by spacer members 41 and fixed to the upright 1 with the aid of bolts or rivets 42 engaged through holes 11 in the upright and corresponding holes 43 made in the plates. It will be observed that each plate 40 has two superposed notches 44 cut out therein, of which each defines two horizontal opposing referenced 45 and 46.

It will be appreciated that, by appropriately dimensioning the spacer member 41, the bush or tenon 3 is capable of being engaged between the plates 40 of the female member or mortise 4, in the manner illustrated in FIGS. 2 and 3. As shown in FIG. 2, the stops 30 are introduced in notches 44 with the result that the shoulders 31 and 32 abut against the contact surfaces constituted by the horizontal edges 45 and 46 of the notches. The threaded rod 20 is, of course, seated in the groove 10 of upright 1, with the result that any overhang effect is virtually eliminated, in the same manner as in the French Patent mentioned in the preamble.

For adjusting the frame CL in height with respect to cable 2, it suffices that the operator rotates the bush 3 in one direction or the other, by acting on the hexagonal section 34, the counter-nut 35 being tightened once the desired position has been attained. The operation involves the use only of two conventional spanners and it will be observed that it is further simplified by the good accessibility of pieces 34 and 35, which are located in the upper part of the frames. The inner threading 33 of bush 3 is perfectly protected without risk of being damaged; the same applied to the threading of rod 20 which cannot come into contact with the two plates 40 due to the presence of bush 3.

As in the prior French Patent, coupling of the heddle frame CL on cable 2 does not require any fixing member, the connection resulting from the simple fit of the bush or tenon 3 in the member or mortise 4 due to the parallel bearing surfaces made on the tenons and mortises. However, it goes without saying that, in order to avoid any risk of untimely separation under the effect of vibrations, the conventional frame guides provided laterally on the fixed structure of the loom are conserved, taking care that such frame guides 5 (FIG. 1) cooperate with a smooth part 22 provided to that end on each of the rods 20.

It goes without saying that the number of stops 30 (and consequently the number of annular shoulders and contact surfaces) may vary to a wide extent. For certain applications, there may be one sole stop 30 cooperating with a single notch 44.

What is claimed is:

1. In a mechanism for forming the shed in a weaving loom including a heddle frame, transmission element and a coupling means for connecting the heddle frame to the transmission element, the combination comprising, a heddle frame having an upright frame member, the coupling means including a tenon element which is selectively receivable within a mortise element, said tenon element including a bush having upper and lower ends and an elongated central axis, an axially aligned opening through said bush, at least a portion of said opening being threaded, said transmission element having a threaded portion which is threadingly engageable with said threaded portion of said opening, said bush having at least two outwardly extending shoulders axially spaced with respect to one another, said mortise element including spaced generally parallel members, said parallel members including spaced contact surfaces, said shoulders of said tenon element being receivable between said spaced contact surfaces of said parallel members, and securing means for attaching said parallel members to said upright of said heddle frame.

2. The combination of claim 1 in which said bush is generally cylindrical in configuration, said at least two outwardly extending shoulders being defined by oppositely oriented annular faces of at least one cylindrical stop, said bush having a first diameter and said cylindrical stop having an diameter greater than said first diameter.

3. The combination of claim 1 including a counter-nut engaged on the threaded portion of said transmission element for selectively engaging said upper end of said bush, and a section of said bush adjacent said upper end thereof being profiled with flat surfaces for facilitating rotation of said bush.

4. The combination of claim 1 in which said parallel members of said mortise element includes a pair of spaced plates, means for connecting said plates in spaced relationship with respect to one another, said contact surfaces including at least one set of horizontally aligned notches formed in said plates, each of said notches having upper and lower edges, said shoulders of said tenon element being receivable between said upper and lower edges within said notches.

5. The combination of claim 4 wherein the upright of the heddle includes a vertical groove formed therein, said transmission element being receivable within said groove.

6. The combination of claim 1 wherein said transmission element includes a rod portion having smooth outer surfaces, and guide means carried by the weaving loom extending adjacent to said rod portion for retaining said tenon element in seated relationship with respect to said mortise element.

7. In a mechanism for forming the shed in a weaving loom including a heddle frame, transmission element and a coupling means for connecting the heddle frame to the transmission element, the combination comprising, a heddle frame having an upright frame member, the coupling means including a tenon element which is selectively receivable within a mortise element, said tenon element including a bush having upper and lower ends and an elongated central axis, an axially aligned opening through said bush, at least a portion of said opening being threaded, said transmission element having a threaded portion which is threadingly engageable with said threaded portion of said opening, said bush having at least two stops extending outwardly there-from, said stops having upper and lower shoulders axially spaced with respect to one another, said mortise element including spaced generally parallel plates, means for retaining said plates in spaced relationship, said plates including spaced notches formed therein defined by upper and lower edges, said shoulders of said stops of said tenon elements being receivable between said upper and lower edges of said notches in said plates, and securing means for attaching said plates to said upright of said heddle frame.

* * * * *